US011369158B2

(12) United States Patent
Graves

(10) Patent No.: US 11,369,158 B2
(45) Date of Patent: Jun. 28, 2022

(54) ULTRALIGHT BELT, POCKETBOOK, AND FOOTWEAR

(71) Applicant: Veronica Holland Graves, Dallas, TX (US)

(72) Inventor: Veronica Holland Graves, Dallas, TX (US)

( * ) Notice: Subject to any disclaimer, the term of this patent is extended or adjusted under 35 U.S.C. 154(b) by 88 days.

(21) Appl. No.: 16/828,478

(22) Filed: Mar. 24, 2020

(65) Prior Publication Data

US 2020/0305528 A1 Oct. 1, 2020

Related U.S. Application Data

(60) Provisional application No. 62/823,180, filed on Mar. 25, 2019.

(51) Int. Cl.
*A41F 1/00* (2006.01)

(52) U.S. Cl.
CPC ..... *A41F 1/008* (2013.01)

(58) Field of Classification Search
CPC ... A41F 1/008; A45F 2200/0516; A45F 5/021
See application file for complete search history.

(56) References Cited

U.S. PATENT DOCUMENTS 1,414,816 A * 5/1922 Killion ..... A45F 5/021 24/3.12
4,174,793 A * 11/1979 Wisowaty ..... A45C 11/32 224/240
4,771,927 A * 9/1988 Ventura ..... A45F 5/00 224/250
5,433,359 A * 7/1995 Flowers ..... A45F 5/00 224/222
5,503,316 A * 4/1996 Stewart ..... B60R 7/05 224/312
5,664,292 A * 9/1997 Chen ..... A45F 5/02 24/3.11
5,703,945 A * 12/1997 Smith ..... A45F 5/02 379/446
5,833,100 A * 11/1998 Kim ..... A45F 5/021 224/197
5,850,954 A * 12/1998 Dong-Joo ..... H04B 1/3888 224/197
5,893,497 A * 4/1999 Schaiewitz ..... A45F 5/02 224/182
6,032,337 A * 3/2000 Rankin, Jr. ..... A45F 5/02 24/3.1
6,182,878 B1 * 2/2001 Racca ..... A45C 15/00 224/236
6,209,769 B1 * 4/2001 Seals ..... A45C 1/04 224/583
6,311,881 B1 * 11/2001 Kamiya ..... A45F 5/02 224/195

(Continued)

*Primary Examiner* — Robert Sandy
*Assistant Examiner* — Louis A Mercado
(74) *Attorney, Agent, or Firm* — Norton Rose Fulbright US LLP; Barry Greenbaum

(57) ABSTRACT

An ultralight belt, ultralight crossbody strap, ultralight pocketbook, ultralight tote, ultralight backpack, and ultralight footwear, each having an endoskeletal structure having improved properties such stability, lightness, breathability, expandability, comfort, and/or superior biomechanical alignment and load/weight management distribution.

22 Claims, 7 Drawing Sheets

(56) References Cited

U.S. PATENT DOCUMENTS

| | | | | |
|---|---|---|---|---|
| 6,315,182 | B1 * | 11/2001 | Chen | A45F 5/00 224/271 |
| 6,364,187 | B1 * | 4/2002 | Castellano | A45F 5/02 224/236 |
| 6,425,139 | B1 * | 7/2002 | Ida | A41F 1/008 2/325 |
| 6,454,146 | B2 * | 9/2002 | Alis | A45F 5/02 224/250 |
| 6,752,299 | B2 * | 6/2004 | Shetler | A45F 5/02 224/197 |
| 7,270,255 | B2 * | 9/2007 | Badillo | A45C 9/00 224/191 |
| 8,499,986 | B2 * | 8/2013 | Knight | H04B 1/385 224/197 |
| 8,899,458 | B1 * | 12/2014 | Heien | A45F 5/021 224/675 |
| 9,060,588 | B2 | 6/2015 | Bransfield et al. | |
| 9,259,077 | B2 | 2/2016 | Murphy et al. | |
| D782,185 | S | 3/2017 | Lederer | |
| 9,833,059 | B2 * | 12/2017 | Westbrook | A45F 5/021 |
| 10,530,411 | B2 | 1/2020 | Gehlhausen et al. | |
| 2007/0226958 | A1 * | 10/2007 | Clifton | F41C 33/041 24/3.12 |
| 2013/0048687 | A1 | 2/2013 | Do | |

* cited by examiner

ULTRALIGHT BELT, POCKETBOOK, AND FOOTWEAR

CROSS-REFERENCE TO RELATED APPLICATIONS

This application claims the benefit of priority of U.S. Provisional Patent Application No. 62/823,180 filed Mar. 25, 2019, which is hereby incorporated by reference in its entirety.

FIELD OF THE INVENTION

This invention relates to an ultralight belt, ultralight pocketbook, and ultralight footwear, each having an endoskeletal structure with improved stability, lightness, breathability, expandability, comfort, and/or superior biomechanical alignment and load distribution properties.

BACKGROUND TO THE INVENTION

Existing belts are typically made of heavy and restrictive rigid materials that require belt loops to stay in place. While some belts have elastic materials, they are overall too yielding and erroneously fold-over and fail to maintain stability. Fanny packs tend to flop about the hips, spin around the waist, and are unattractively bulky. Detachable pouches and carrying cases are usually made of heavy and thick construction elements to maintain stability, resulting in increased load and uneven weight distribution upon a user's body.

SUMMARY OF THE INVENTION

The present disclosure may relate to at least one of the above. However, the present disclosure may also prove useful to other technical areas. Therefore, the disclosure should not be construed as necessarily limited to addressing any of the above.

Accordingly, in a non-limiting embodiment of the present invention, a coupling element is provided, comprising a first section having at least one first coupling fastener and configured such that at least a portion of the first section is positioned between an article of clothing and a user, wherein the article of clothing is worn by the user, and a second section having at least one second coupling fastener and configured such that at least a portion of the second section is positioned between the article of clothing and an accessory, wherein the accessory is configured to be removably coupled to the coupling element.

In an alternative non-limiting embodiment of the invention, a third section is configured to be folded over the first section and removably coupled to an exterior side of the first section.

In an alternative non-limiting embodiment of the invention, at least one of the first section, the second section, and the third section is separated from an adjacent section by a cavity.

In an alternative non-limiting embodiment of the invention, the second section is configured to be removably coupled to the accessory.

In an alternative non-limiting embodiment of the invention, the second section is configured to be removably coupled to the accessory via at least one loop or at least one grip, wherein the at least one loop or the at least one grip is adapted to assist the coupling of the accessory to the second section.

In an alternative non-limiting embodiment of the invention, an exterior side of the second section is configured to be removably coupled to the accessory via an adhesive.

In an alternative non-limiting embodiment of the invention, the article of clothing includes at least one endoskeleton structure.

In an alternative non-limiting embodiment of the invention, the at least one endoskeleton structure is at least partially embedded within the article of clothing and disposed between the first section and the second section.

In an alternative non-limiting embodiment of the invention, the at least one first coupling fastener includes multiple coupling fasteners, wherein the multiple coupling fasteners are arranged in two parallel rows along an interior side of the first section and the second section.

In an alternative non-limiting embodiment of the invention, the at least one second coupling fastener includes multiple coupling fasteners, wherein the multiple coupling fasteners are arranged in two parallel rows along an interior side of the second section.

In an alternative non-limiting embodiment of the invention, the coupling element includes at least one pocket, wherein the at least one pocket is disposed within at least one of the first section and the second section.

In a non-limiting embodiment of the present invention, the coupling element includes at least one snap fastener, wherein the at least one snap fastener is situated in the third section and configured to removably couple the third section to the exterior side of the first section.

In a non-limiting embodiment of the present invention, the coupling element is a pocketbook or a portion of a pocketbook.

In a non-limiting embodiment of the present invention, the accessory is a clutch bag, a phone case, a multimedia player, an earbud case, a water bottle, or a coin purse.

In a non-limiting embodiment of the present invention, the coupling element is configured to attach multiple items to the article of clothing.

In a non-limiting embodiment of the present invention, the article of clothing is a belt, crossbody sash, jacket, pants, footwear, hat, briefcase, handbag, purse, or tote bag.

In a non-limiting embodiment of the present invention, the coupling element is configured to attach to a phone mount.

In a non-limiting embodiment of the present invention, the first section includes at least one exoskeleton structure.

In a non-limiting embodiment of the present invention, the coupling element includes at least two exoskeleton structures.

In a non-limiting embodiment of the present invention, a coupling element is provided, comprising a first section having at least one first coupling fastener, and a second section having at least one second coupling fastener and configured to be removably coupled to an accessory.

In an alternative non-limiting embodiment of the invention, a third section is configured to be folded over the first section and removably coupled to an exterior side of the first section.

In a non-limiting embodiment of the present invention, a method is provided, comprising inserting a first section of a coupling element between an article of clothing and a user, wherein the article of clothing is worn by the user, wherein the first section has at least one first coupling fastener, attaching a second section of the coupling element to an accessory, wherein the second section has at least one second coupling fastener.

In an alternative non-limiting embodiment of the invention, folding a third section of the coupling element over the first section to removably couple the third section to an exterior side of the first section.

The present disclosure may be embodied in the form illustrated in the accompanying drawings. However, attention is called to the fact that the drawings are illustrative. Variations are contemplated as being part of the disclosure.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

Preferred embodiments of the invention will now be described with reference to the following drawings in which.

DETAILED DESCRIPTION OF PREFERRED EMBODIMENTS

Figure 1:
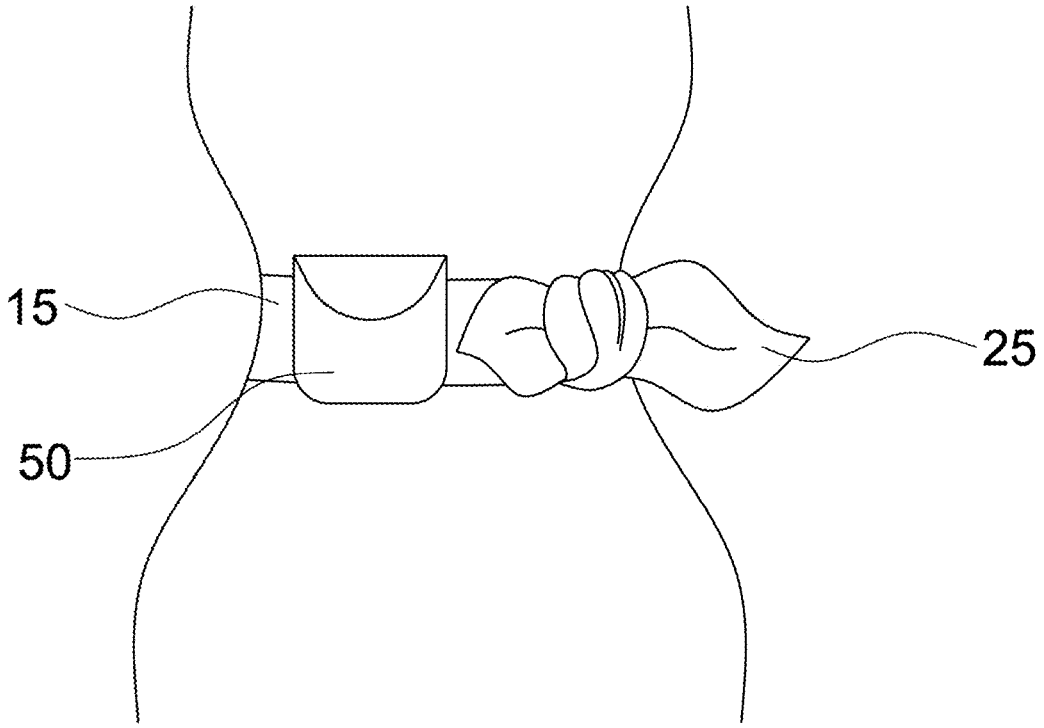
FIG. 1 shows a front view of an ultralight belt with an attached ultralight modular pocketbook in accordance with a first embodiment of the invention.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art. In addition, features described with respect to certain example embodiments may be combined in and/or with various other example embodiments. Different aspects and/or elements of example embodiments, as disclosed herein, may be combined in a similar manner.

The terminology used herein can imply direct or indirect, full or partial, temporary or permanent, action or inaction. For example, when an element is referred to as being "on," "connected," "coupled" or "attached" to another element, then the element can be directly on, connected, coupled, or attached to the other element and/or intervening elements may be present, including indirect and/or direct variants. In contrast, when an element is referred to as being "directly connected" or "directly coupled" or "directly attached" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular embodiments only and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof. Further, alternate terminology should not be limited necessarily as exclusionary, but can be inclusionary as well.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

A preferred embodiment of the invention is illustrated in FIG. 1, which shows a front view of an ultralight belt with an ultralight modular pocketbook 50 attached thereto. The modular pocketbook 50, which may be a pocket, a case, a clutch, or a pouch, etc., may be attached to the ultralight belt via at least one of being clipped, wrapped, snapped, hooked, threaded, magnetized, or otherwise removably attached or permanently attached to the ultralight belt as known to one skilled in the art. In an alternative embodiment (not shown), the ultralight belt is worn standalone without any pocketbooks attached thereto, or multiple pocketbooks may be modularly attached to the ultralight belt, depending on the preferences or needs of the wearer.

Ultralight modular pocketbook 50 may also be permanently or removably affixed to a cross-body strap or sash, an alternate means of hands free ultralight modular pocketbook 50 carry. The cross-body strap or sash may contain one or more endoskeleton 10 components.

FIG. 1 also shows a wrap around sash style embodiment of the belt secured via knot or bow. The fastening and securing ends of the belt 25, known to those skilled in the art as the tongue end or ends or buckle end, may be permanently attached to belt sleeve front panel 15, or may be removably attached thereto via hooks, snaps, Velcro, or other means.

Figure 2:
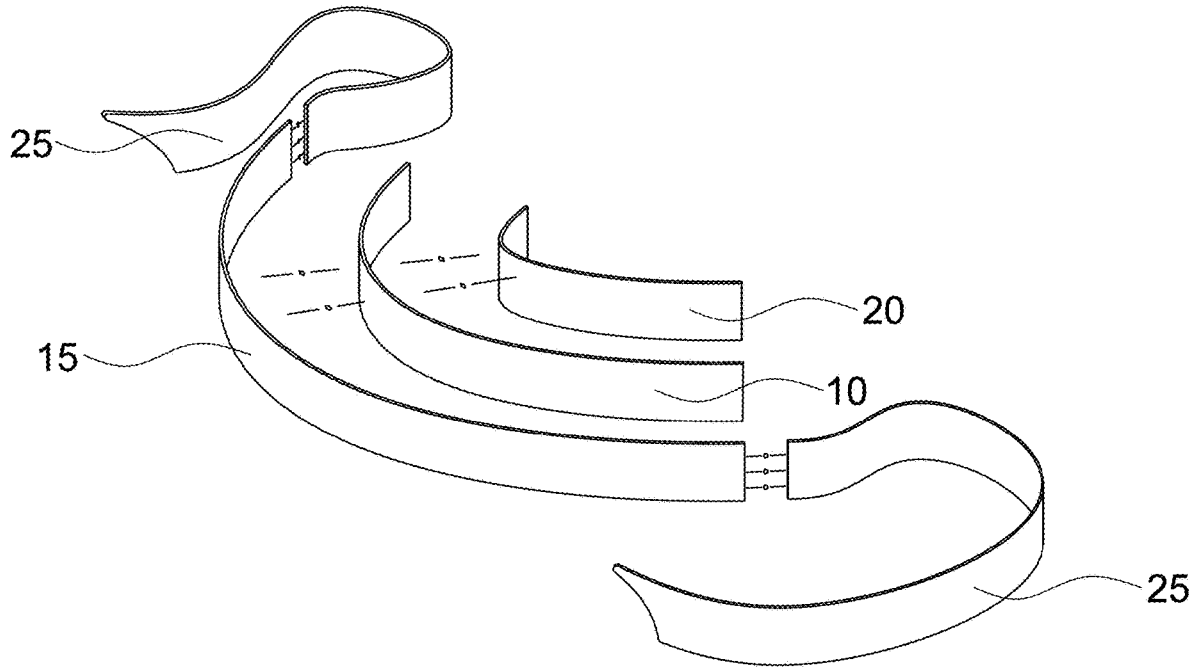
FIG. 2 shows an exploded front-perspective view of an ultralight belt having a front panel, belt endoskeleton, and rear panel in accordance with a further embodiment of the invention.

Belt tongue or sash ends 25 may include webbing such as elasticized webbing or Lycra™ for stretching, or other suitable textiles or combination of textiles. Belt tongue or sash 25 may also include hardware or fastening elements, such as belt buckles, sash buckles, tongue keepers or other suitable buckling or securing elements. In the embodiment of FIG. 2, no hardware or fastening elements are used in belt tongue or sash 25.

In addition, D-rings, Tri-Glides, or other belt keepers and adjusters known to those skilled in the art may be used for management and adjustment of tongue or sleeve segments. In an alternative embodiment, no D-rings, Tri-Glides, or other belt keepers and adjusters are used.

In an example embodiment, the ultralight belt may be partially or entirely, permanently or non-permanently, attached to a skirt or skirting material, or to a vest, to afford a user modesty, for example, for wear with athleisure leggings. As mentioned above, ultralight belt may also provide a stable support system for removably or permanently attaching pockets, pouches, clutch bags, or other carrying cases due at least in part to its belt endoskeleton 10 structure (described below).

FIG. 2 shows an example embodiment of an ultralight belt having a belt sleeve front panel 15, a belt sleeve back panel 20, and a belt endoskeleton 10 at least partially disposed between the front panel 15 and the back panel 20. Also shown in FIG. 2 is belt tongue or sash 25 attached to belt sleeve front panel 15 at both ends of front panel 15.

Belt endoskeleton 10 may be made of a firm but flexible structure having polyester or synthetic fibers, waterproof paper, plastic, rubber, metal (for use in heavier duty applications such as a holster clip for firearms), or other material with flexible, semi-rigid and rigid properties.

In a preferred embodiment, belt endoskeleton 10 is at least partially made of a waterproof paper that has at least one of tearproof, washable, submersible, and recyclable properties. In another embodiment, belt endoskeleton 10 is at least partially made of a wood pulp based waterproof paper such as, for example, Rite in the Rain® paper. Alternatively, belt endoskeleton 10 is at least partially made of a synthetic paper made from polyester such as, for example, TerraSlate™ paper. In yet another embodiment, belt endoskeleton 10 is at least partially made of a synthetic material such as polyolefin, for example, REVLAR® Soft paper.

Belt endoskeleton 10 may be entirely concealed by belt sleeve front panel 15. In an alternative embodiment, belt endoskeleton 10 may be only partially concealed by belt sleeve front panel 15. In addition, belt endoskeleton 10 may be formed of a single endoskeleton segment, or may include two or more endoskeleton segments which may entirely or partially be concealed by belt sleeve front panel 15.

Belt endoskeleton 10 may extend an entire length of the ultralight belt or may extend only a partial length of the ultralight belt, and may be permanently or removably affixed to any section of the ultralight belt.

In a preferred embodiment, belt endoskeleton 10 is made from two endoskeleton segments, is entirely concealed by belt sleeve front panel 15, each endoskeleton 10 extending one third the distance of sleeve front panel 15 towards the sleeve center, and is disposed between belt sleeve front panel 15 and belt sleeve rear panel 20.

Belt endoskeleton 10 may have elastic properties and coil in response to the application of a force or removal of a force. The elastic properties may allow for a relatively tight and compressed fitting of the belt around the user's waist area. Belt endoskeleton may be constructed of silicone elastomer and entirely exposed, without cover of belt sleeves or panels.

Belt sleeve front panel 15 and belt sleeve rear panel 20, shown in FIG. 2, may be made of any textile, including knits, elastomers, wovens, leather, cork, or any suitable natural or synthetic textiles, or combinations of textiles.

In an example embodiment, belt sleeves 15 and 20 may be made of water-friendly materials, such as Lycra™, for use in wet climates and water recreation, and due to the structure and material of the ultralight belt, and in particular belt endoskeleton 10, waterproof pouches for holding valuables may be attached to the belt.

Belt sleeves 15 and 20 may be in the form of a hollow sleeve or tube, which may be one continual hollow sleeve from end to end or may be conjoined with one or more belt tongues or sashes 25. As a result, belt sleeves 15 and 20 may be used as a pipeline for threading circuitry or tubing, for example, for power sources (such as batteries) or refillable or replaceable canisters (such as vaporous gases or cooling or heating agents), as a means of connecting garments to supply from containment pouches or receptacles attached to the belt.

Figure 3:
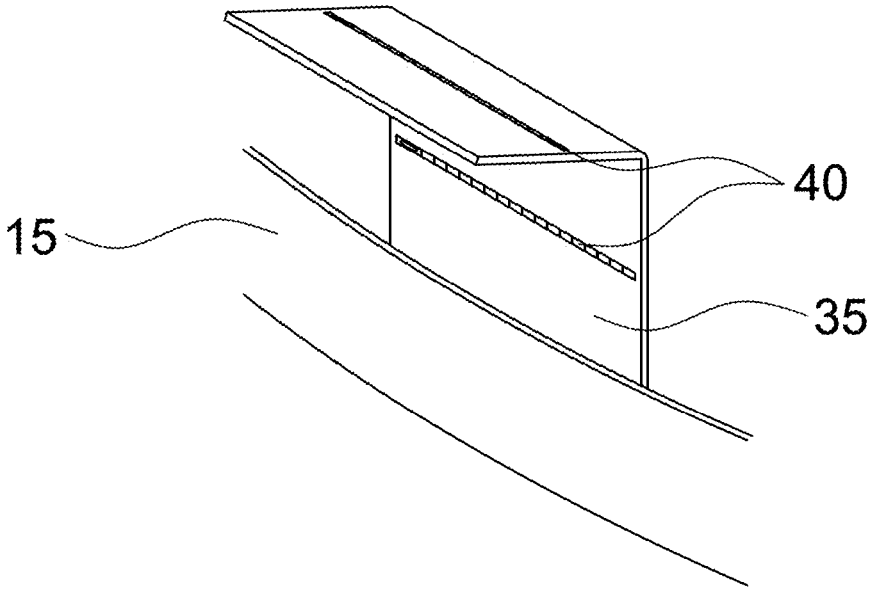
FIG. 3 shows a front-perspective view of a modular ultralight pocketbook unfolded with its rear pocket segment partially tucked into an ultralight belt in accordance with a further embodiment of the invention.

FIG. 3 shows an example embodiment of a modular ultralight pocketbook with its rear pocket partially tucked into ultralight belt 15. As shown in FIG. 3, the pocketbook includes two zippers 40, one disposed at an internal part of the pocketbook and the other disposed at an external part of the pocketbook. Each zipper may be configured to open and close to thereby allow access or prevent access to the pocket sleeve contents. For example, zipper 40 disposed at the internal part of the pocketbook allows or prevents access to contents of pocket sleeve 35. Pocket sleeve 35 may be partially tucked into belt 15 and attached to belt 15.

Figure 4:
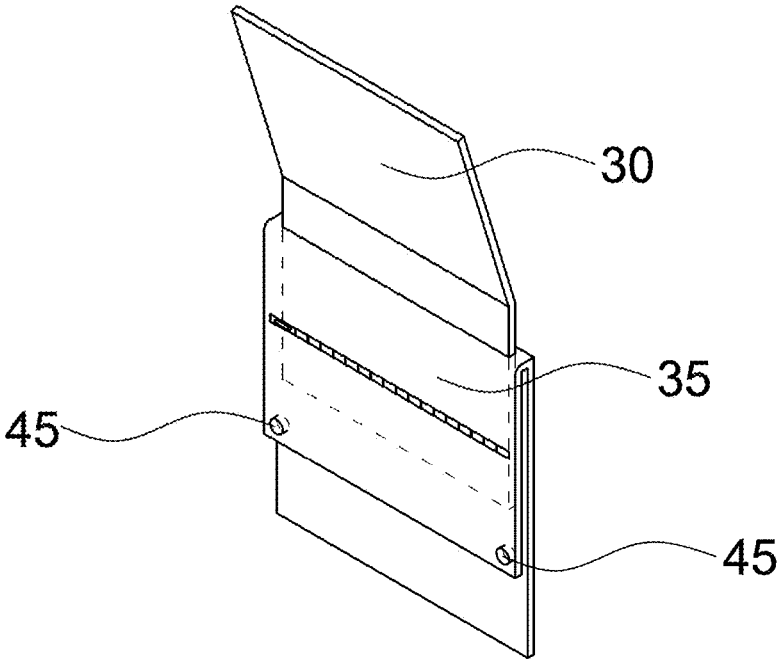
FIG. 4 shows a front-perspective view of an ultralight modular pocketbook with a pocket endoskeleton partially inserted into a removable pocket sleeve in accordance with a further embodiment of the invention.

FIG. 4 shows an example embodiment of an ultralight modular pocketbook with a modular pocket endoskeleton 30 partially inserted into a removable pocket sleeve 35 via zipper 40. Pocket sleeve 35 is disposed at an external part of the pocketbook. Also shown in FIG. 4 are magnets 45, which may be disposed at opposing ends of pocket sleeve 35 to magnetically attach a foldable section of pocket endoskeleton 30 to an adjacent or opposite portion of pocket sleeve 35.

Modular pocket endoskeleton 30 may be a firm but flexible structure made of polyester, synthetic, or waterproof paper, or plastic, rubber, metal, or other material with flexible and semi-rigid or rigid properties. Modular pocket endoskeleton 30 may provide a stable support system for the carrying of pockets, pouches, clutch bags, or other carrying cases and their contents. In a preferred embodiment, modular pocket endoskeleton 30 is made of a waterproof paper that is at least one of tearproof, washable, submersible, and recyclable. Modular pocket endoskeleton 30 may be made from a wood pulp based waterproof paper such as, for example, Rite in the Rain® paper. Alternatively, modular pocket endoskeleton 30 may be made from a synthetic paper made from polyester such as, for example, TerraSlate™ paper. In another embodiment, modular pocket endoskeleton 30 may be made from a synthetic material such as polyolefin, for example, REVLAR® Soft paper.

Modular pocket endoskeleton 30 may be constructed as a standalone pocket element, or may be combined with pocket sleeve 35, and entirely concealed by pocket sleeve 35. In an alternative embodiment, modular pocket endoskeleton 30 is only partially concealed by pocket sleeve 35.

Modular pocket endoskeleton 30 may be formed of a single endoskeleton segment or may include two or more endoskeleton segments, which segments may entirely or partially be concealed by pocket sleeve 35.

Modular pocket endoskeleton 30 may also extend the entire length of pocket sleeve 35 or may extend only a partial length of pocket sleeve 35, and may be permanently or removably affixed to any section of pocket sleeve 35.

In a preferred embodiment, modular pocket endoskeleton 30 is made from a single endoskeleton segment, is entirely concealed by pocket sleeve 35, and extends the full length of pocket sleeve 35.

In an alternate embodiment, the modular pocketbook may be constructed as a tote bag, and may be used in combination with other accessories or as stand alone. In another alternate embodiment, the modular pocketbook may be constructed as a backpack, and used or in combination with straps, sashes, or other accessory element or elements.

Pocket sleeve 35 may be made of any textile, including knits, wovens, leather, cork, or any suitable natural or synthetic textiles, or combinations of textiles. Pocket sleeve 35 may be permanently or removably affixed to pocket endoskeleton 30, and may be constructed of any variety of lengths and widths, for purposes of carrying items such as, cell phone, keys, lip balm, cash, passport, water container, etc.

Pocket sleeve 35 may contain any number of pocketed compartments, and may be non-securely or securely closeable via zippers, snaps, Velcro, hooks, etc. Pocket sleeve 35 may also include magnets 45, clips, hooks, or any fastening element for securely enhanced attachment to the ultralight belt, any other type of belt, or any garment waistband or any apparel or accessory opening or aperture, such as a pocket.

Figure 5:
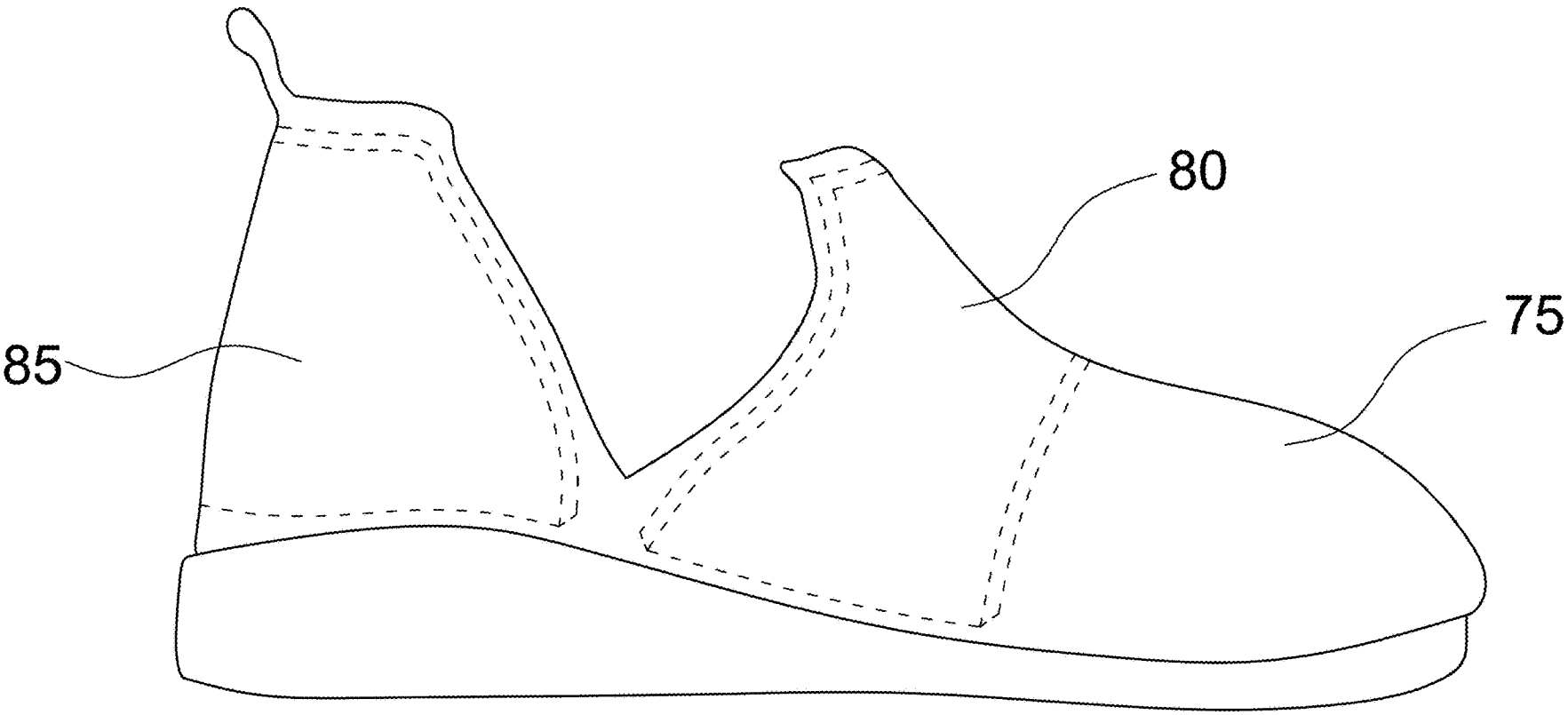
FIG. 5 shows a side view of an ultralight footwear boot embodiment with two footwear endoskeletons in accordance with a further embodiment of the invention.

FIG. 5 shows an example embodiment of an ultralight footwear having a first footwear endoskeleton 80 in a vamp and a second footwear endoskeleton 85 in a heel counter. Also shown is the upper 75 and sole of the footwear, which may be a boot. The upper 75 of the boot may be composed of canvas, linen, jersey knits, or any suitable textile, regardless of how yielding, soft and/or lightweight.

First footwear endoskeleton 80 and second footwear endoskeleton 85 may each be made of a firm but flexible structure including polyester, synthetic, or waterproof paper, or plastic, rubber, metal, or other material with flexible and semi-rigid properties. In a preferred embodiment, footwear endoskeletons 80 and/or 85 are made of a waterproof paper that is at least one of tearproof, washable, submersible, and recyclable. Footwear endoskeletons 80 and/or 85 may be made from a wood pulp based waterproof paper such as, for example, Rite in the Rain® paper. Alternatively, footwear endoskeletons 80 and/or 85 may be made from a synthetic paper made from polyester such as, for example, TerraSlate™ paper. In another embodiment, footwear endoskeletons 80 and/or 85 may be made from a synthetic material such as polyolefin, for example, REVLAR® Soft paper.

First footwear endoskeleton 80 and second footwear endoskeleton 85 may be formed of a single endoskeleton segment or may include two or more segments, which segments may be separate, partially attached, or a singular continuous unit. First footwear endoskeleton 80 and second footwear endoskeleton 85 may be permanently or removably affixed to any section of the shoe, such as upper or sole. First footwear endoskeleton 80 and second footwear endoskeleton 85 may also be partially or entirely incorporated into the construction of the upper, sole, or upper and sole of the footwear.

Figure 6:
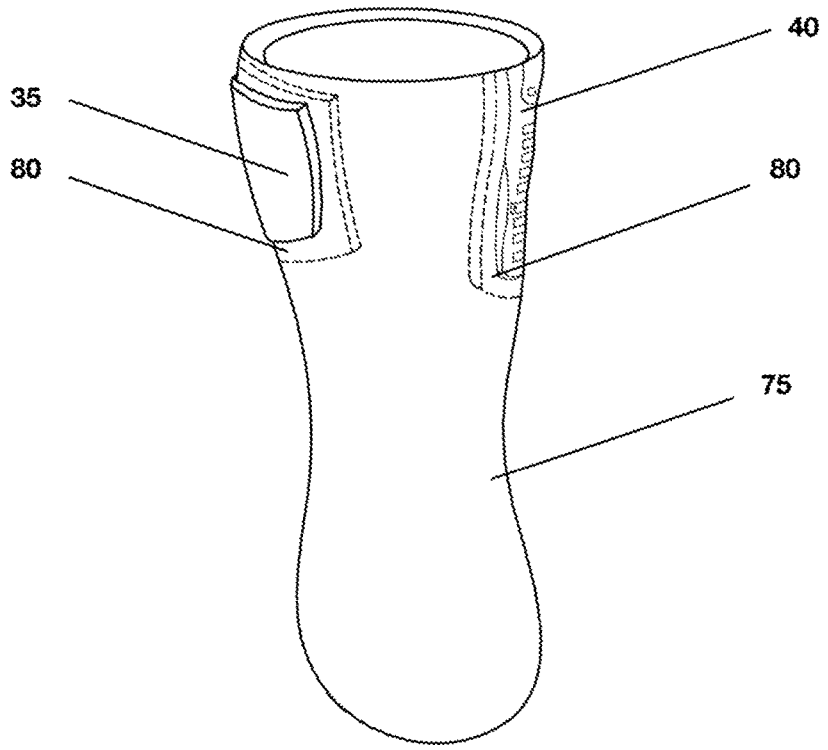
FIG. 6 shows a front-perspective view of an embodiment of a footwear boot vamp composed of ultralight and highly flexible textile and augmented with suspension endoskeleton elements in accordance with a further embodiment of the invention.

FIG. 6 shows an example embodiment of a footwear boot vamp formed of, for example, an ultralight and highly flexible textile which is augmented with suspension endoskeleton elements 80. Also shown is the upper 75 which may be composed of canvas, linen, jersey knits, or any suitable textile, regardless of how yielding, soft and/or lightweight, as described above with respect to the embodiment of FIG. 5. In an example embodiment, the ultralight shoe or boot may be made from extremely pliable, lightweight, or sheer textiles, while having stabilizing and anchoring properties for fixably or removably attaching objects of utility, such as pockets or storage sleeves, coupling elements, suspension elements, fastening elements or closure elements such as zippers, or decorative embellishments.

The footwear shown in FIG. 6 may include a pocket sleeve 35 and a zipper 40, each described above. Suspension endoskeleton elements 80 may be made of a firm but flexible structure including polyester, synthetic, or waterproof paper, or plastic, rubber, metal, or other material with flexible and semi-rigid properties, and may be formed of a single endoskeleton segment or may include two or more segments, which segments may be separate, partially attached, or a singular continuous unit, as described above. Suspension endoskeleton elements 80 may be permanently or removably affixed to any section of the shoe, such as upper or sole, and may also be partially or entirely incorporated into the construction of the upper, sole, or upper and sole of the footwear, as described above.

Figure 7:
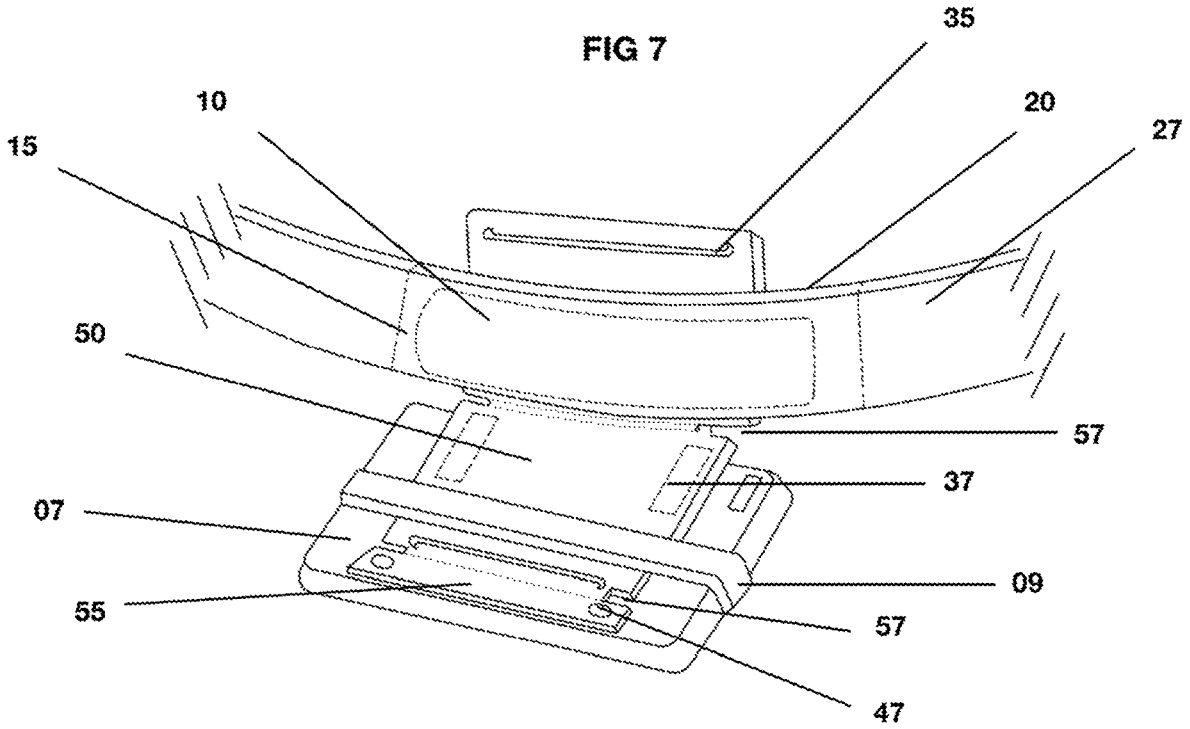
FIG. 7 shows a front-perspective view of an embodiment of a coupling element in the form of a pocketbook which is threaded through a cell phone case grip and paired with a sash belt augmented with a detachable endoskeletal suspension element inserted into a sleeve of the sash belt in accordance with a further embodiment of the invention.

FIG. 7 shows an example embodiment of a coupling element 50 in the form of a pocketbook 50. While coupling element 50 may be used stand alone as an ultralight modular pocketbook 50 for compartmentalizing and hand carry of personal essentials, such as cash, cards, earbuds, a cell phone or multimedia player, and other relatively small handheld items, coupling element 50 may also serve as an intervening element for coupling hand carry items, such as coupling a clutch bag with a belt, coupling a phone case to a tote bag, or coupling other carry accessories or clothing items together.

Coupling element 50 may be wrapped around or attached to a belt, or attached to an intervening suspension element that may be attached to, or paired with, an accessory item such as a belt, tote or clothing item, or coupling element 50 may be tucked into a waistband or pocket, sleeve or aperture. Coupling element 50 may be fixedly or removably attached to a cell phone or multimedia player, or any hand carry item, such as case or pocketbook, clutch bag, etc. or a boot, or shoe. As shown in FIG. 7, coupler element 50 may be threaded through a cell phone case grip 9 of a cell phone case 7 and paired with a sash belt 27 augmented with a detachable suspension element 10 inserted into a sash belt sleeve 15. While a cell phone case grip 9 is shown, other attachment elements may be used instead of or in addition to case grip 9.

Coupling element 50 may have three sections some or all of which are foldable in one or more directions to create a secure attachment between an accessory such as cell phone case 7 and an article of clothing such as belt 27. As shown in FIG. 7, the middle section (second section) and the bottom sections (closure flap 55; third section) of coupling element 50 may be folded upward toward sash belt 27 and toward the upper section (first section) of coupling element 50 which is situated behind sash belt 27 along belt sleeve rear panel 20, and then bottom section of coupling element 50 may be folded further over the upper section of coupling element 50 and mated to an outer side of coupling element 50 via one or more snap fasteners 47 situated along closure flap 55, or via magnets, clips, hooks, or any other fastening element for a secure enhanced attachment to the outer side of coupling element 50. In this way, cell phone 5 may be securely attached via cell phone case grip 9 and via coupling element 50 to sash belt 27.

Coupling element 50 may include one or more cavities 57. Each section of coupling element 50 may be separated from one another by a coupling cavity 57 to thereby provide greater tolerance for expanding dimensions of user added contents, and/or for example, wrapping the coupler around diverse depths of accessories, such as relatively thick belts. The coupler cavities may also serve as pass-through channels for looping elastics to harness hand carry items, such as cell phone 5 to coupling element 50.

Coupling element 50 may include one or more adaptive coupling fasteners 37 to allow, for example, for adaptive coupling with a plurality of belt widths or other suspension elements. Adaptive coupling fasteners 37 may be situated along inner sides of the coupling element 50 in a longitudinal direction of the coupling element 50. In an example embodiment, multiple adaptive coupling fasteners 37 are spaced apart from each other in a longitudinal direction and along two edges of coupling element 50. Other orientations and arrangements of the adaptive coupling fasteners 37 are within the scope of the present invention.

Figure 9:
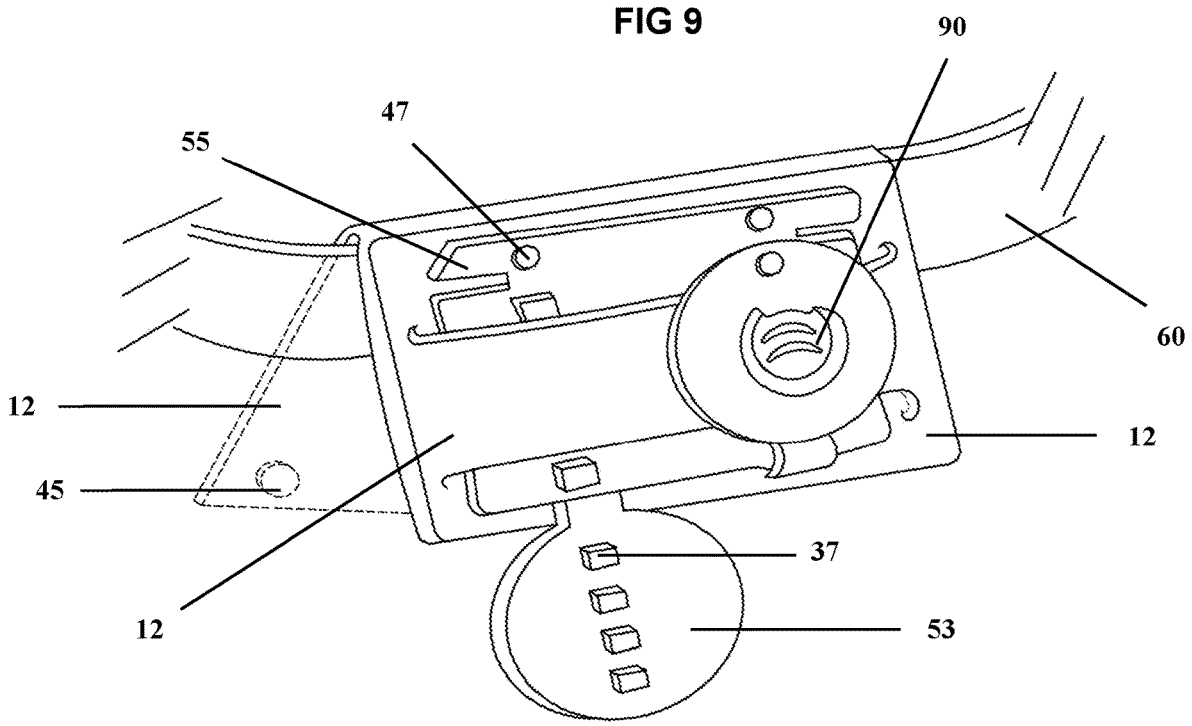
FIG. 9 shows a front-perspective view of an embodiment of a coupling element in the form of a pocketbook which has dual articulating panels threaded through a suspension element that is partially folded and tucked into a clothing waistband in accordance with a further embodiment of the invention.

Coupling element 50 may contain permanently or non-permanently affixed intervening elements, such as Velcro, snaps, flush mounting system, phone grips or mounts (as shown in FIG. 9), elasticized harnesses, retainer or retainers, or other intervening fastening or attachment elements. For example, the intervening fasteners may allow for adaptively mating a pocketbook, phone 5, or other personal and hand carry items with accessories and clothing, and may allow for customized performance, with an avoidance of gaping, slipping, sliding, flopping, sagging, twisting, bulging, and other failure risks and undesirable performance issues associated with having a cell phone 5 or other weighted item attached to a sash belt 27 or other clothing accessory.

Coupling element 50 may be constructed of a single panel or multiple pocket panels, allowing for the coupling of a single item to an accessory or clothing, or coupling of multiple hand carry items to an accessory, such as a multimedia player and earbud case to a belt, or a flask water bottle and coin purse to a waistband. Coupling element 50 may be composed of single or multiple flexible, rigid, or semi-rigid segments or parts, fixably or removably connected.

Figure 8:
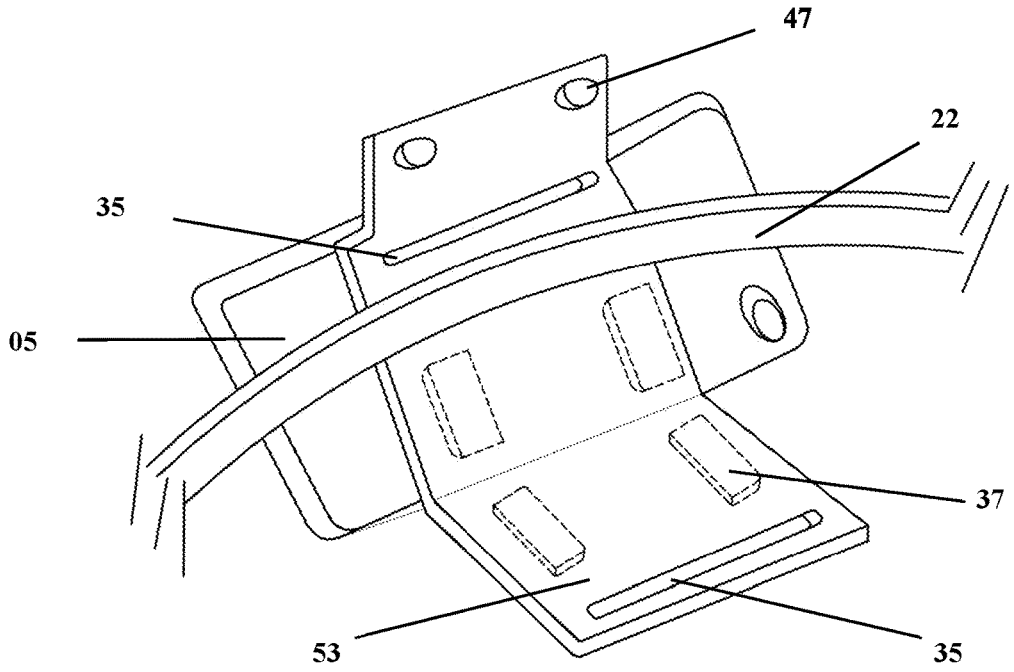
FIG. 8 shows a rear-perspective view of an embodiment of a coupling element in the form of a pocketbook which is adhesively affixed to a cell phone and partially paired with a narrow width belt accessory in accordance with a further embodiment of the invention.

FIG. 8 shows an example embodiment of a coupling element 50 adhesively affixed to a cell phone 5 and partially paired with a narrow width belt accessory 22. In contrast to FIG. 7, which shows cell phone 5 attached to coupling element 50 via phone grip 9, cell phone 5 is adhesively affixed to pocketbook coupler 50.

As shown in FIG. 8, and described in more detail with respect to FIG. 7, coupling element 50 may have three sections that are foldable in at least three directions to create the secure attachment to narrow width belt accessory 22. Pocketbook panel 53 which, while in use, rests between narrow width belt accessory 22 and a wearer's body, connects to snap fasteners 47 after it is folded over pocketbook panel 53.

Also shown in FIG. 8 are adaptive coupling fasteners 37 which may prevent, for example, slippage of narrow width belt accessory 22 and/or cell phone 5, as described above.

FIG. 9 shows an example embodiment of a coupling element with dual articulating panels 53 threaded through a suspension element 12 that is partially folded and tucked into a clothing waistband 60. Articulating panels 53 may be used to couple a cell phone grip holder mount 90 for removable holding of a cell phone.

Suspension element 12 may include or be formed of at least one endoskeletal, an exoskeletal, or a partially exposed component, for stabilizing and standardizing a section of an accessory or garment, especially those of lightweight or very flexible materials, for example, for attachably receiving a pocketbook, clutch bag, multimedia player or other hand carry item or items for hands free carry. Without the stabilizing component (e.g. endoskeletal or exoskeletal), the accessory and/or garment would likely sag, twist or move around, presenting an uncomfortable feeling for a user.

Suspension element 12 may be composed of a single or multiple flexible, rigid, or semi-rigid segments or parts, each fixably or removably connected. Suspension element 12 may also augment accessories or garments with reliably standardized rigidity, dimensionality, and orientation for pairing with a coupler and carry accessories and personal items. Suspension element 12 may also be used independently, or combined with a coupler, or with any hand carry accessories or personal items.

Suspension element 12 may be inserted, threaded, sewn, adhesive adhered, welded seamed, keyhole flush mounted, magnetized, Velcro type attached, harnessed, retained, or otherwise removably or fixably attached to any accessory or clothing articles, such as a belt, sash, tubular belt, tote, handbag, clutch bag, backpack, boot, or shoe.

The description of the present disclosure has been presented for purposes of illustration and description, but is not intended to be fully exhaustive and/or limited to the disclosure in the form disclosed. Many modifications and variations in techniques and structures are apparent to those of ordinary skill in the art without departing from the scope and spirit of the disclosure. For example, the endoskeletons, belt sleeves, belt tongue/sash, pocket sleeves may be formed of other similar materials resulting in similar functions to those described above, e.g., fabric or metal, elastic or non-elastic. Accordingly, such modifications and variations are contemplated as being a part of the present disclosure. It will further be appreciated that endoskeletons described above may be used modularly for attachment to other articles of clothing or accessories than those described above, or may be constructed as part of, or integrated with, the other article of clothing or accessory.

LIST OF REFERENCE NUMERALS

5 CELL PHONE
7 CELL PHONE CASE
9 PHONE GRIP
10 SUSPENSION ELEMENT ENDOSKELETON
12 SUSPENSION ELEMENT EXOSKELETON
15 BELT SLEEVE FRONT PANEL
20 BELT SLEEVE REAR PANEL
22 BELT INTERIOR SIDE
25 BELT TONGUE/SASH
27 TUBULAR BELT

30 POCKET ENDOSKELETON
35 POCKET SLEEVE
37 ADAPTIVE COUPLING FASTENER
40 ZIPPER
45 MAGNET
47 SNAP FASTENER
50 POCKETBOOK
53 POCKETBOOK PANEL
55 CLOSURE FLAP
57 COUPLING CAVITY
60 CLOTHING WAISTBAND
75 BOOT UPPER
80 FOOTWEAR ENDOSKELETON WITHIN BOOT VAMP
85 FOOTWEAR ENDOSKELETON WITHIN BOOT HEEL COUNTER
90 CELL PHONE GRIP HOLDER MOUNT

What is claimed is:

1. A combination comprising:
an article of clothing intended to be worn by a user;
a coupling element including:
a first section having at least one first coupling fastener and configured such that at least a portion of the first section is positioned between the article of clothing and the user; and
a second section having at least one second coupling fastener and configured such that at least a portion of the second section is positioned between the article of clothing and an accessory,
wherein the accessory is configured to be removably coupled to the coupling element,
wherein the article of clothing includes at least one endoskeleton structure.

2. The combination of claim 1, further comprising:
a third section configured to be folded over the first section and removably coupled to an exterior side of the first section.

3. The combination of claim 2, wherein at least one of the first section, the second section, and the third section is separated from an adjacent section by a cavity.

4. The combination of claim 2, further comprising:
at least one snap fastener, wherein the at least one snap fastener is situated in the third section and configured to removably couple the third section to the exterior side of the first section.

5. The combination of claim 1, wherein the second section is configured to be removably coupled to the accessory.

6. The combination of claim 5, wherein the second section is configured to be removably coupled to the accessory via at least one loop or at least one grip, wherein the at least one loop or the at least one grip is adapted to assist coupling of the accessory to the second section.

7. The combination of claim 1, wherein an exterior side of the second section is configured to be removably coupled to the accessory via an adhesive.

8. The combination of claim 1, wherein the at least one endoskeleton structure is at least partially embedded within the article of clothing and disposed between the first section and the second section.

9. The combination of claim 1, wherein the at least one first coupling fastener includes multiple coupling fasteners, wherein the multiple coupling fasteners are arranged in two parallel rows along an interior side of the first section.

10. The combination of claim 1, wherein the at least one second coupling fastener includes multiple coupling fasteners, wherein the multiple coupling fasteners are arranged in two parallel rows along an interior side of the second section.

11. The combination of claim 1, further comprising:
at least one pocket, wherein the at least one pocket is disposed within at least one of the first section and the second section.

12. The combination of claim 1, wherein the coupling element is a pocketbook or a portion of a pocketbook.

13. The combination of claim 1, wherein the accessory is a clutch bag, a phone case, a multimedia player, an earbud case, a water bottle, or a coin purse.

14. The combination of claim 1, wherein the coupling element is configured to attach multiple items to the article of clothing.

15. The combination of claim 1, wherein the article of clothing is a belt, jacket, pants, footwear, hat, briefcase, handbag, purse, or tote bag.

16. The combination of claim 1, wherein the coupling element is configured to attach to a phone mount.

17. The combination of claim 1, wherein the first section includes at least one exoskeleton structure.

18. The combination of claim 17, wherein the coupling element includes at least two exoskeleton structures.

19. A combination comprising:
an article of clothing intended to be worn by a user;
a coupling element including:
a first section having at least one first coupling fastener and configured such that at least a portion of the first section is positioned between the article of clothing and the user; and
a second section having at least one second coupling fastener and configured such that at least a portion of the second section is positioned between the article of clothing and an accessory,
wherein the accessory is configured to be removably coupled to the coupling element,
wherein the article of clothing includes at least one endoskeleton structure, and
wherein the first section includes at least one exoskeleton structure.

20. The combination of claim 19, further comprising:
a third section configured to be folded over the first section and removably coupled to an exterior side of the first section.

21. A method comprising:
inserting a first section of a coupling element between an article of clothing and a user,
wherein the article of clothing is worn by the user,
wherein the first section has at least one first coupling fastener; and
attaching a second section of the coupling element to an accessory,
wherein the second section has at least one second coupling fastener,
wherein at least a portion of the second section is positioned between the article of clothing and the accessory,
wherein the article of clothing includes,
(i) at least one endoskeleton structure and/or,
(ii) the first section includes at least one exoskeleton structure.

22. The method of claim 21, further comprising:
folding a third section of the coupling element over the first section to removably couple the third section to an exterior side of the first section.

* * * * *